US009848684B2

(12) United States Patent
Kim et al.

(10) Patent No.: US 9,848,684 B2
(45) Date of Patent: Dec. 26, 2017

(54) TUBULAR CONTAINER COMPRISING APPLICATOR

(71) Applicant: YONWOO CO., LTD., Incheon (KR)

(72) Inventors: You-Seob Kim, Incheon (KR); Min-goo Kim, Incheon (KR); Ki-Young Ham, Incheon (KR)

(73) Assignee: YONWOO CO., LTD., Incheon (KR)

( * ) Notice: Subject to any disclaimer, the term of this patent is extended or adjusted under 35 U.S.C. 154(b) by 0 days.

(21) Appl. No.: 15/508,000

(22) PCT Filed: Apr. 15, 2016

(86) PCT No.: PCT/KR2016/003927

§ 371 (c)(1),
(2) Date: Mar. 1, 2017

(87) PCT Pub. No.: WO2016/171431

PCT Pub. Date: Oct. 27, 2016

(65) Prior Publication Data

US 2017/0295905 A1 Oct. 19, 2017

(30) Foreign Application Priority Data

Apr. 24, 2015 (KR) ..... 10-2015-0058044

(51) Int. Cl.

| | |
|---|---|
| ***B43M 11/06*** | (2006.01) |
| ***A45D 34/04*** | (2006.01) |
| ***B65D 47/42*** | (2006.01) |
| ***B65D 47/06*** | (2006.01) |
| ***B65D 41/00*** | (2006.01) |
| ***A45D 40/26*** | (2006.01) |

(52) U.S. Cl.

CPC ..... *A45D 34/04* (2013.01); *A45D 40/26* (2013.01); *B65D 41/005* (2013.01); *B65D 47/065* (2013.01); *B65D 47/42* (2013.01)

(58) Field of Classification Search

CPC .... A45D 2200/1009; A45D 2200/1018; A45D 34/04; A45D 40/26; B65D 47/065; B65D 83/0066

USPC ..... 401/183, 186

See application file for complete search history.

(56) References Cited

U.S. PATENT DOCUMENTS 4,993,859 A * 2/1991 Assad ..... A47L 23/05 401/206

FOREIGN PATENT DOCUMENTS

| | | | |
|---|---|---|---|
| JP | 2006-297084 A | 11/2006 | |
| KR | 10-1103188 B1 | 1/2012 | |

(Continued)

OTHER PUBLICATIONS

International Search Report issued in PCT/KR2016/003927 dated Aug. 5, 2016.

Written Opinion issued in PCT/KR2016/003927 dated Aug. 5, 2016.

*Primary Examiner* — Jennifer C Chiang

(74) *Attorney, Agent, or Firm* — Marshall, Gerstein & Borun LLP

(57) ABSTRACT

A tubular container includes an applicator that not only easily controls a slope degree of the support body, by installing a rotation control part at an inner side of a support body, when applying contents onto skin by using an applicator or massaging, but also prevents the deformation of an upper portion of the support body which is coupled with the applicator through a rotation control part, such that assemblability with the applicator is improved and thus separation of the applicator is prevented.

6 Claims, 5 Drawing Sheets

(56) References Cited

FOREIGN PATENT DOCUMENTS

| | | | |
|---|---|---|---|
| KR | 10-1180737 | B1 | 9/2012 |
| KR | 10-1411990 | B1 | 6/2014 |
| KR | 2014-0074573 | A | 6/2014 |
| KR | 10-1533095 | B1 | 7/2015 |

* cited by examiner

TUBULAR CONTAINER COMPRISING APPLICATOR

BACKGROUND

The present disclosure relates to a tubular container comprising an applicator, wherein a tubular container comprising an applicator can not only easily control a slope degree of the support body, by installing a rotation control part at an inner side of a support body, when applying contents onto skin by using an applicator or massaging, but also prevent the deformation of an upper portion of the support body which is coupled with the applicator through a rotation control part, such that assemblability with the applicator is improved and thus separation of the applicator is prevented.

Generally, a tubular container comprises a tube body receiving contents therein and provided with a discharging part where contents are discharged at an upper part thereof; and an over cap which is detachably coupled to the discharging part and opens/closes the discharging part.

In the tube container as the above, when the tube body is pressurized, inner pressure of the container body is changed and thereby contents are discharged through a discharging part. To make it easy to apply contents, the container provided with an applicator is being used, wherein the applicator, such as a brush, is coupled to an upper structure of the tubular container, and absorbs contents and discharges to the outside.

Meanwhile, the interest in skincare increases recently. However, since it is hard to get an enough amount of contents absorbed into the skin and a contentable skincare effect just by a simple absorption, there have been tried various methods to transfer heat or coldness to the skin so as to promote the metabolism and improve elasticity of the skin. One of tubular containers for cosmetics as the above is discloses in the publicized patent no. 10-2008-0099816 (hereafter called as the publicized patent).

The publicized patent above is related to a dispenser, comprising a housing which is provided with a reservoir for storing contents; a heat storage tip which is coupled to the housing, composed of metal or ceramic, and provided with an application face for applying contents onto skin surface; and an insert which is disposed inside the application face of the heat storage tip and forms a contents moving passage. The contents moving passage extends through the heat storage tip and terminates inside an opening port of the application face, and the insert is composed of thermoplastic polymer.

The above publicized patent, however, is configured to transfer heat or coldness to user's facial skin through a heat storage tip when applying contents on user's facial skin, but the heat storage tip cannot be smoothly adjusted to the contour of user's skin. Therefore, there arises a problem that user's facial skin is irritated when applying contents onto user's facial skin through the heat storage tip or massaging.

Furthermore, since the opening port is formed at the application face of the heat storage tip, the insert, which is a contents moving passage, is penetrated through the opening port of the application face and contents are discharged while the contents moving passage is exposed to the outside. Therefore, there arises a problem wherein contents discharged through the contents moving passage flow into a space formed by the insert and the opening port, and are stuck therein, thereby resulting in contamination of the heat storage tip.

To solve the problem in the above, "Tubular container having applicator", having an applicator whose angle can be adjusted according to the contour of skin, is disclosed in the registered patent No. 10-1411990 (hereafter called as the registered patent).

The registered patent comprises: a tube body which stores contents and is provided with a discharging part so as to discharge contents at an upper portion thereof; a support body which is coupled to the discharging part and forms a contents movement passage at an interior thereof such that contents discharged through the discharging part can be moved; an applicator which is coupled, encasing an upper portion of the support body and applies contents onto user's facial skin, forming a contents discharging hole which is connected with the contents movement passage at a central portion thereof and discharges contents moving through the contents movement passage to the outside; and an over cap which is coupled to the discharging part, encasing the support body, and forms an opening/closing rod which opens/closes the contents discharging hole at an inner side thereof.

In addition, the registered patent is characterized in that the support body, composed of elastic material, has a structure wherein an upper portion thereof can be rotated 360 degrees on an axis of a lower portion thereof such that the angle of the applicator can be changed according to the contour of the skin.

However, the registered patent has a problem wherein assemblability with the applicator decreases due to deformation of the support body made of elastic material, thereby causing the applicator to be easily separated.

Furthermore, in a process that an over cap is clamped with a discharging part while the support body contracts, the support body is possible to fall down with the applicator, which leads to a problem that it is hard for the over cap to be clamped.

Furthermore, since the support body made of elastic material is configured to be elastically deformed without constraint, it is not easy for a user to control an inclining angle of the support body when the applicator contacts user's skin.

SUMMARY OF THE DISCLOSURE

The presently disclosed embodiments are devised to solve the problems above, and its goal is to provide a tubular container comprising an applicator, wherein a tubular container comprising an applicator can not only easily control a slope degree of the support body, by installing a rotation control part at an inner side of a support body, when applying contents onto skin by using an applicator or massaging, but also prevent the deformation of an upper portion of the support body which is coupled with the applicator through a rotation control part, such that assemblability with the applicator is improved and thus separation of the applicator is prevented.

Furthermore, it is to provide a tubular container comprising an applicator, wherein an over cap can be easily clamped by preventing a support body from being contracted through a rotation control part in a process that the over cap is clamped with a fixing body.

To solve such problems described in the above, a tubular container comprising an applicator is featured to comprise: a tube body receiving contents therein and coupled with a discharging part at an upper portion thereof such that contents can be discharged; a support body coupled at an upper portion of the discharging part, forming a contents movement passage at an interior thereof such that contents discharged through the discharging part can flow in, and made of elastic material such that an upper portion of the support body can rotate 360 degrees on an axis of a lower portion thereof; an applicator coupled to an upper portion of the support body, forming a contents discharging hole at a center portion thereof, and applying contents onto the user's skin with an angle thereof changed by deformation of the support body according to the contour of user's skin surface; a rotation control part inserted into the interior of the support body, supporting the applicator with a upper portion thereof coupled to an inner side of the applicator, and contacted to an inner circumferential surface of the support body, thereby controlling deformation of the support body; a fixing body coupled to the discharging part, encasing a lower portion of the support body, and fixing the support body to the discharging part; and an over cap coupled to the fixing body, encasing the support body and the applicator, and forming an opening/closing rod which opens/closes the contents discharging hole at an inner side.

Furthermore, it is featured that the rotation control part includes a rotation axis which is secured to an inner side of the discharging part and controls a slope degree of the support body, and a contents movement part, which extends to an upper portion of the rotation axis and is closely contacted to an upper inner circumferential surface of the support body, forming a contents inflow hole and a contents movement hole such that contents moving through the contents movement passage can move to the contents discharging hole.

Furthermore, it is featured that at an outer circumferential surface of the contents movement part is formed a limiting protrusion which limits an upward movement of the contents movement part, and at an inner side of the support body is formed a supporting protrusion which supports an upper end of the limiting protrusion.

Furthermore, it is featured that at an outer circumferential surface of the contents movement part is formed a separation preventing protrusion so as to prevent the applicator from being separated from the support body, and at an inner side of the applicator is formed a protrusion which meets a lower end of the separation preventing protrusion.

Furthermore, it is featured that at an inner side of the discharging part is formed a multitude of securing protrusions formed with an interval, forming a space where contents move.

Furthermore, it is featured that at an outer circumferential surface of the discharging part is formed a rotation preventing protrusion which prevents the fixing body from being rotated in a process that the over cap is coupled to the fixing body, and at an inner circumferential surface of the fixing body is formed a rotation preventing groove which is coupled with the rotation preventing protrusion.

As described above, by installing a rotation control part at an inner side of the support body, it is possible to control a slope degree of the support body when applying contents or massaging skin surface, using an applicator. And it is also possible to improve an assemblability with the applicator by preventing deformation of an upper portion of the support body which is coupled to the applicator through the rotation control part, and thereby to prevent the applicator for being separated.

Furthermore, it is possible to prevent contraction of the support body through the rotation control part in a process that the over cap is clamped to the fixing body, and thereby to easily clamp the over cap.

DETAILED DESCRIPTION OF PREFERRED EMBODIMENTS

Figure 1:
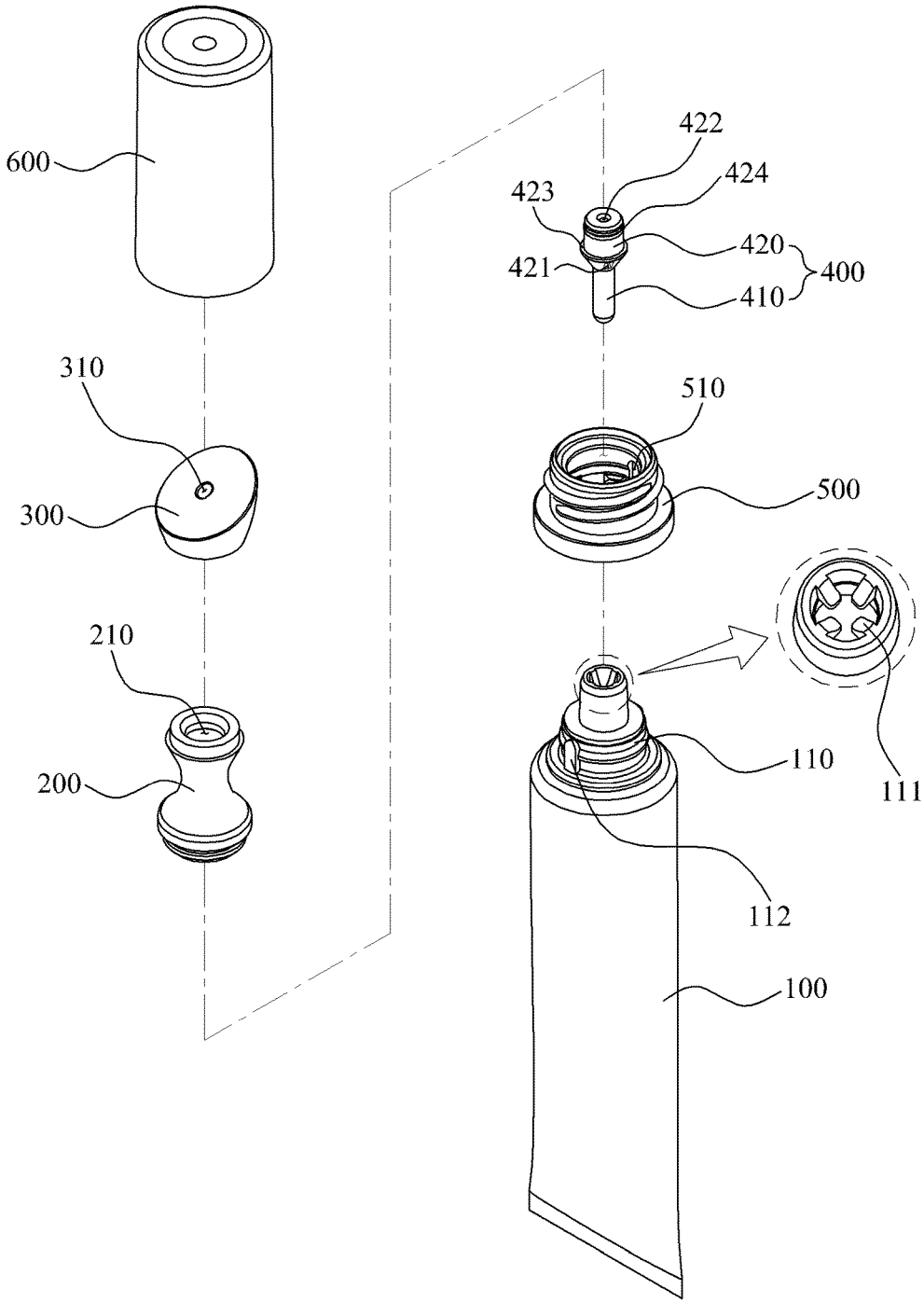
FIG. 1 is an exploded perspective view illustrating a configuration of a tubular container comprising an applicator according to an exemplary embodiment.

Hereinafter, exemplary embodiments will be described in detail with reference to the accompanying drawings. The same reference numerals provided in the drawings indicate the same members.

Figure 2:
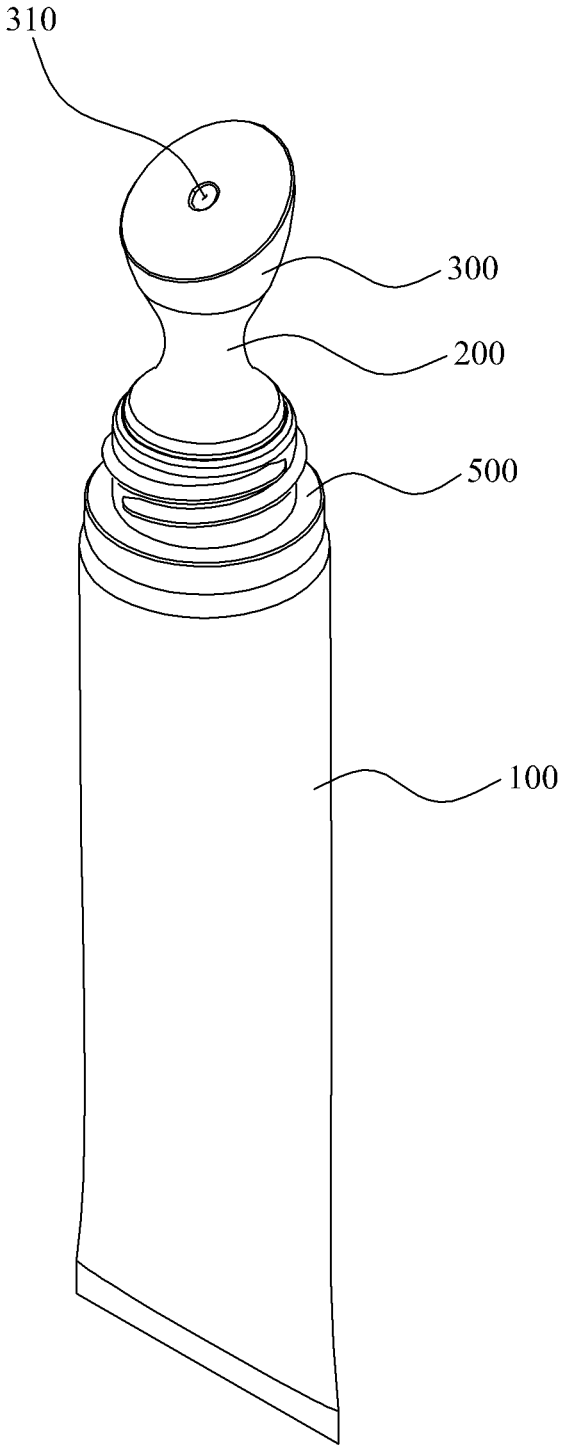
FIG. 2 is an assembled perspective view illustrating a configuration of a tubular container comprising an applicator according to an exemplary embodiment.
Figure 3:
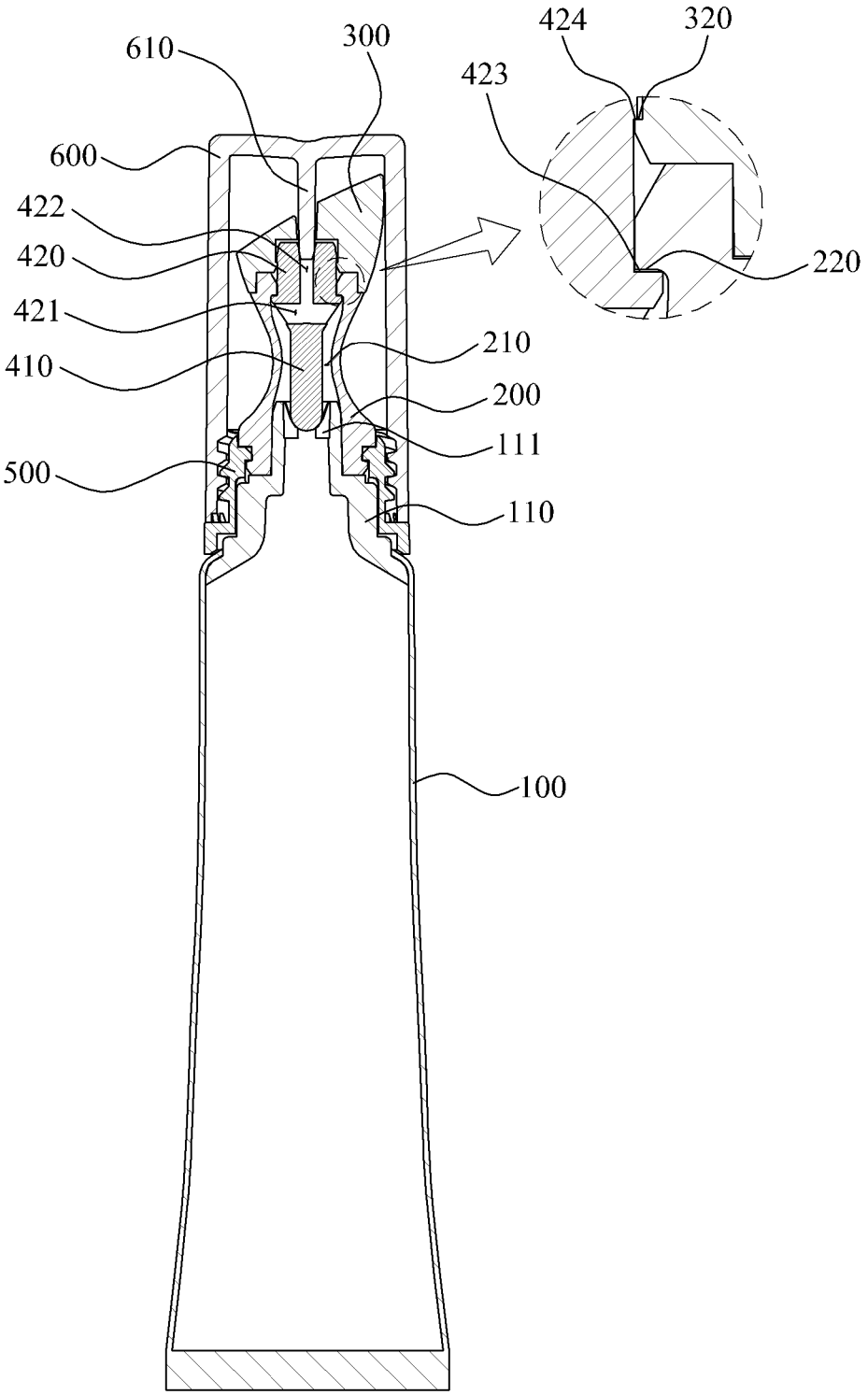
FIG. 3 is an assembled cross-sectional view illustrating a configuration of a tubular container comprising an applicator according to an exemplary embodiment.

FIG. 1 is an exploded perspective view illustrating a configuration of a tubular container comprising an applicator according to an exemplary embodiment. FIG. 2 is an assembled perspective view illustrating a configuration of a tubular container comprising an applicator according to an exemplary embodiment. FIG. 3 is a assembled cross-sectional view illustrating a configuration of a tubular container comprising an applicator according to an exemplary embodiment.

Referring to FIGS. 1 to 3, a tubular container comprising an applicator according to an exemplary embodiment may include a tube body 100, a support body 200, an applicator 300, a rotation control part 400, a fixing body 500, and an over cap 600.

The tube body 100 receiving contents is deformed according to user's pressurization, and is made of soft tube material such that contents can be discharged by an inner pressure thereof.

At an upper portion of the tube body 100 is formed a discharging part 110 such that contents stored in the tube body 100 can be discharged by pressurization of the tube body 100, wherein a multitude of securing protrusions, forming a space where contents flow in, are formed with an interval at an inner side of the discharging part 110 so as to support a lower end of a rotation axis 410 to be described later.

Furthermore, a rotation preventing protrusion 112 is formed at an outer circumferential surface of the discharging part 110 so as to prevent a fixing body 500 from being rotated in a process that an over cap 600 to be described later is coupled to a fixing body 500.

The support body 200 is coupled to the discharging part 110 and supports an applicator 300, forming a contents movement passage 210 at an interior thereof such that contents discharged through the discharging part 110 may move. A lower portion of the contents movement passage 210 is connected to the discharging part 110, and an upper portion thereof is connected to a contents inflow hole 421 of a rotation control part 400 such that contents discharged through the discharging part 110 can flow into the contents inflow hole 421.

In the presently described embodiments, it is featured that the support body 200 is made of elastic material, such that it is possible to change an angle of the applicator 300 by elastic force according to a skin contour when applying contents onto skin through the discharging part 110.

Figure 4:
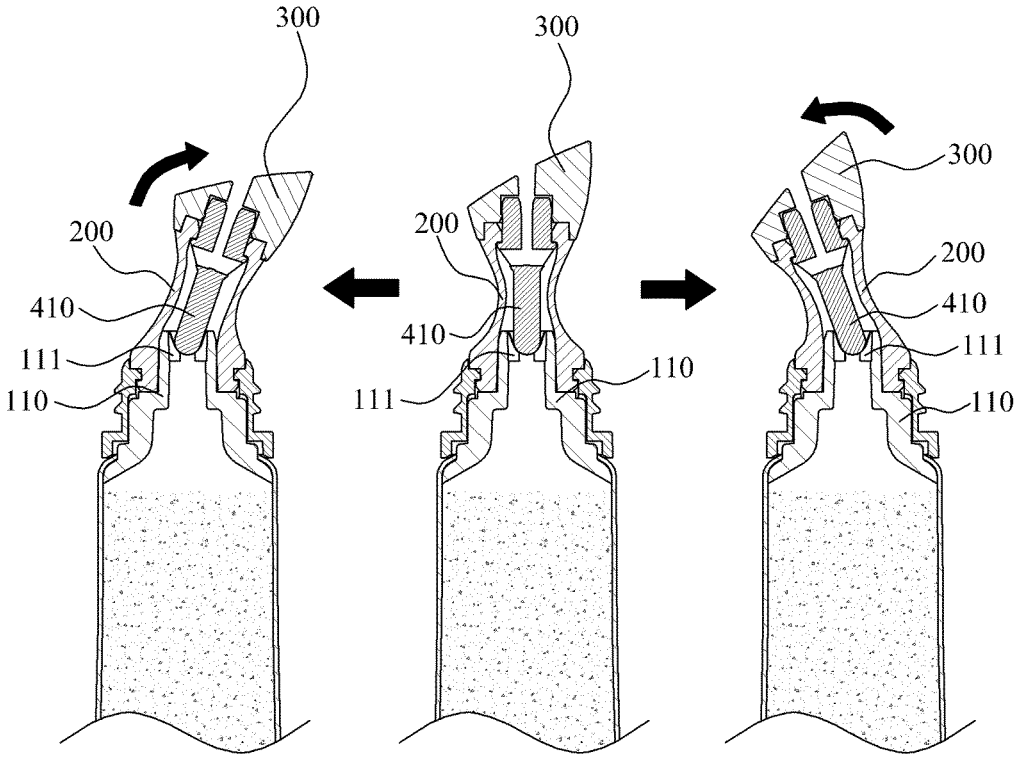
FIG. 4 is a view illustrating an angle change of an applicator according to rotation of a support body of a tubular container comprising an applicator according to an exemplary embodiment.

The support body 200 is configured to be rotated on an axis of a lower portion thereof so as to smoothly change an angle of the applicator 300 coupled to an upper portion thereof. When the support body 200 slopes to either side as the applicator gets to contact user's skin, as illustrated in FIG. 4, a side surface of the rotation axis 410 gets to contact one side of an upper end of the discharging part 110 and thereby controls a slope degree thereof.

The support body 200 can be configured to be rotated to various angles; however, it is preferred to be configured to be rotated 360 degrees on an axis of a lower portion thereof.

Meanwhile, at an inner side of the support body 200 is formed a supporting protrusion 220 which supports an upper end of a limiting protrusion 423 of a contents movement part 420 so as to prevent the rotation control part 400 from moving upwards and being separated from the support body 200.

The applicator 300, which is coupled, encasing an upper portion of the support body 200 and applies contents onto user's skin, forms a contents discharging hole 310 which is connected with a contents movement hole 422 at a center portion thereof, and discharges contents moving through the contents movement hole 322 to the outside, wherein the contents discharging hole 310 is configured to be disposed directly above the contents movement hole 422 and is connected with the contents movement hole 422.

In the presently described embodiments, it is featured that when contents discharged through a contents discharging hole 310 is applied onto skin, as illustrated in FIG. 4, the applicator 300 applies contents as its angle gets smoothly changed according to a contour of user's skin surface. Due to this, it is possible to apply contents or massage effectively, minimizing irritation of skin.

Meanwhile, the applicator 300, when applying contents discharged through the contents discharging hole 310, touches user's skin with an upper surface thereof and transfers coldness or heat onto the skin, thereby enhancing metabolism of facial skin and improving elasticity of the skin. For this purpose, the applicator can be made of metal having a high heat transfer rate, such as ceramic, plastic, or rubber which is able to transfer heat.

Furthermore, it is possible that the applicator 300 has a shape of circle, sphere, or other various shapes according to regions where cosmetics are applied.

Meanwhile, at an inner side of the applicator 300 is formed a protrusion 320 which meets a lower end of a separation preventing protrusion 424 of a contents movement part 420 so as to prevent the applicator 300 from being separated from the support body 200.

The rotation control part 400, which is inserted into an inner side of the support body 200, supporting the applicator 300 and controlling a slope degree of the support body 200, further includes a rotation axis 410 and a contents movement part 420.

The rotation axis 410 is secured at a securing protrusion 111 of the discharging part 110 and controls a slope degree of the support body 200, wherein when the support body 200 slopes to either side as the applicator 300 gets to contact user's skin, the side gets to contact one side of an upper end of the discharging part 110, and thereby controls the slope degree of the support body 200.

The rotation axis 410 is configured to fix the rotation control part 400 to an inner side of the support body 200 in a state of being secured to the securing protrusion 111. Due to this, by preventing the support body 200 from being deformed in a process of fixing the over cap 600 to the fixing body, it is possible to clamp the over cap 600 to the fixing body 500 with ease.

The contents movement part 420 extends to an upper portion of the rotation axis 410 and guides contents moving through the contents movement passage 210 to move to a contents discharging hole 310. A contents inflow hole 421 is formed at a side of the contents movement part such that contents moving through the contents movement passage 210 may flow in, and a contents movement hole 422 is formed at an upper end thereof such that contents flowed in through the contents inflow hole 421 may move.

In the presently described embodiments, the contents movement part 420 is closely contacted to an upper inner circumferential surface of the support body 200 and controls an upper portion of the support body 200 from being deformed. Therefore, when applying contents onto skin through an applicator 300 or massaging, in case an upper portion of the support body 200 deforms to an inner side direction, a coupling force with the applicator 300 decreases and thereby the applicator 300 is possible to be separated from the support body 200. At this moment, the contents movement part 420 gets closely contacted and blocks an upper portion of the support part 200 from being deformed to an inner side direction, thereby preventing the applicator 300 from being separated from the support body 200.

At an upper outer circumferential surface of the contents movement part 420 is formed a separation preventing protrusion 424 which supports an upper end of a protrusion 320 of the applicator 300 so as to prevent the applicator 300 from being separated from the support body 200.

Meanwhile, at an outer circumferential surface of the contents movement part 420 is formed a limiting protrusion 423 which is supported by a lower end of a supporting protrusion 220 of the support body 200 so as to limit an upward movement of the contents movement part 420.

The fixing body 500, which encases a lower portion of the support body 200 and is coupled to the discharging part 110, thereby fixing the support body 200 to the discharging part 110, further forms a screw thread at an outer circumferential surface such that the over cap 600 may be screw-coupled, wherein a rotation preventing groove 510 which is coupled to the rotation preventing protrusion 112 is formed at an inner circumferential surface so as to prevent the fixing body 500 from rotating in a process of the over cap 600 being screw-coupled.

The over cap 600 is coupled to the fixing body 500, encasing the support body 200 and the applicator 300, wherein at an inner upper side thereof is formed an opening/closing rod 610 which is protrusively formed to a downward direction and opens/closes the contents discharging hole 310 and the contents movement hole 422.

Figure 5:
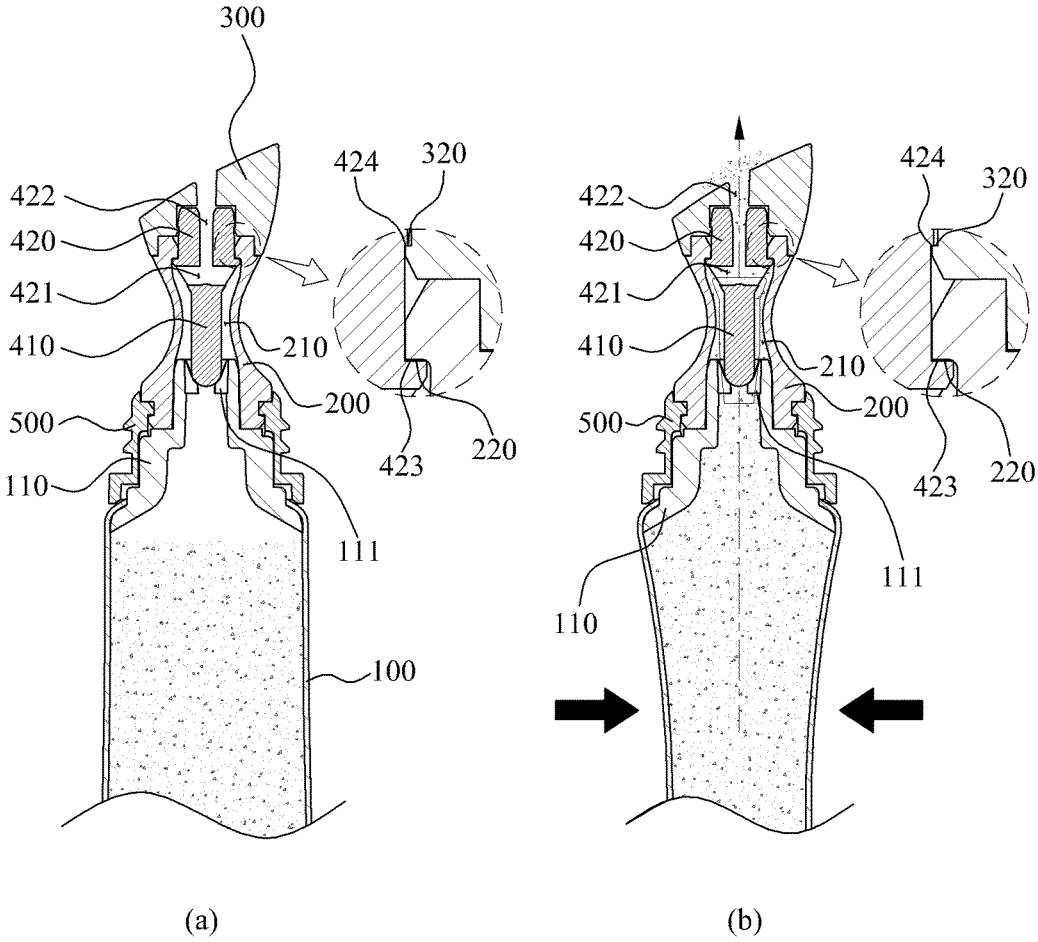
FIG. 5 is a view illustrating an operational state of a tubular container comprising an applicator according to another exemplary embodiment.

Hereinafter, referring FIG. 5, a discharging process of contents of a tubular container comprising an applicator according to an exemplary embodiment will be described. FIG. 5 is a view illustrating an operational state of a tubular container comprising an applicator according to another exemplary embodiment. As illustrated in FIG. 5, when a user pressurizes a tube body 100, contents stored in the tube body 100 then move to a contents movement passage 210 of the support body 200 through a space where a multitude of securing protrusions 111 provided at an inner side of the discharging part 110 form. The contents moving to a contents movement passage 210 is flowed into an interior of a contents movement part 420 through the contents inflow hole 421 of a rotation control part 400, and then go through a content movement hole 422 and are discharged to the outside through a contents discharging hole 310.

As the above, in a process of contents discharge, contents which move through the contents movement passage 210 is not directly discharged to the contents discharging hole 310. Instead, after contents are flowed into an interior of the contents movement part 420 through the contents inflow hole 421 and then pass through the contents movement hole 422, a discharging direction thereof is changed for being discharged to the contents discharging hole 310, such that it is possible to prevent contents from being rapidly discharged and injected.

As described above, optimal embodiments have been disclosed in the drawings and the specification. Although specific terms have been used herein, these are only intended to describe the disclosed embodiments and are not intended to limit the meanings of the terms or to restrict the scope of the accompanying claims. Therefore, those skilled in the art will appreciate that various modifications and other equivalent embodiments are possible from the above embodiments. Therefore, the scope of the accompanying claims should be defined by the technical spirit of the present disclosure.

What is claimed is:

1. A tubular container comprising an applicator comprising:

a tube body receiving contents therein and coupled with a discharging part at an upper portion thereof;

a support body, coupled at the discharging part, forming a contents movement passage at an interior thereof such that contents discharged through the discharging part can flow in, and made of elastic material such that an upper portion thereof can rotate 360 degrees on an axis of a lower portion thereof;

an applicator, coupled to an upper portion of the support body and forming a contents discharging hole at a center portion thereof, thereby applying contents onto user's skin with an angle thereof changed by deformation of the support body according to the contour of user's skin surface;

a rotation control part inserted into the interior of the support body, supporting the applicator with an upper portion thereof coupled to an inner side of the applicator, and contacted to an inner circumferential surface of the support body, thereby controlling deformation of the support body;

a fixing body, coupled to the discharging part and encasing a lower portion of the support body, fixing the support body to the discharging part; and an over cap, coupled to the fixing body and encasing the support body and the applicator, forming an opening/closing rod which opens/closes the contents discharging hole at an inner side.

2. The tubular container comprising an applicator of claim 1, wherein the rotation control part includes a rotation axis secured at an inner side of the discharging part and controlling a slope degree of the support body, and contents movement part, extending to an upper portion of the rotation axis and closely contacted to an inner circumferential surface of the support body, having a contents inflow hole and a content movement hole such that contents moving through the contents movement passage may flow in.

3. The tubular container comprising an applicator of claim 2, wherein at an outer circumferential surface of the contents movement part is formed a limiting protrusion which controls an upward movement of the contents movement part, and at an inner side of the support body is formed a supporting protrusion which supports an upper end of the limiting protrusion.

4. The tubular container comprising an applicator of claim 2, wherein at an outer circumferential surface of the contents movement part is formed a separation preventing protrusion so as to prevent the applicator from being separated from the support body, and at an inner side of the applicator is formed a protrusion which meets a lower end of the separation preventing protrusion.

5. The tubular container comprising an applicator of claim 2, wherein a multitude of securing protrusions are formed with an interval at an inner side of the discharging part, forming a space where contents move, so as to support a lower end of the rotation axis.

6. The tubular container comprising an applicator of claim 2, wherein a rotation preventing protrusion is provided at an outer circumferential surface of the discharging part so as to prevent the fixing body from being rotated in a process that the over cap is coupled to the fixing body, and a rotation preventing groove coupled with the rotation preventing protrusion is formed at an inner circumferential surface.

* * * * *